US006851970B2

(12) United States Patent
Yamanashi

(10) Patent No.: US 6,851,970 B2
(45) Date of Patent: Feb. 8, 2005

(54) JOINT CONNECTOR

(75) Inventor: Hidenori Yamanashi, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/126,548

(22) Filed: Apr. 22, 2002

(65) Prior Publication Data

US 2002/0155753 A1 Oct. 24, 2002

(30) Foreign Application Priority Data

Apr. 20, 2001 (JP) ..... P2001-122644

(51) Int. Cl.[7] ..... H01R 31/08
(52) U.S. Cl. ..... 439/509; 439/499
(58) Field of Search ..... 439/499, 507, 439/509, 67, 496, 271, 272

(56) References Cited

U.S. PATENT DOCUMENTS 3,653,498 A * 4/1972 Kisor ..... 439/507
3,771,102 A * 11/1973 Murray et al. ..... 439/507
5,326,275 A * 7/1994 Murakami ..... 439/507
5,580,282 A * 12/1996 Paterek ..... 439/271
6,254,411 B1 * 7/2001 Chapman et al. ..... 439/507

FOREIGN PATENT DOCUMENTS

| | | |
|---|---|---|
| JP | 5-47442 | 2/1993 |
| JP | 8-22870 | 1/1996 |
| JP | 11-307196 | 11/1999 |

* cited by examiner

*Primary Examiner*—Tho D. Ta
*Assistant Examiner*—Felix O. Figueroa
(74) *Attorney, Agent, or Firm*—Sughrue Mion, PLLC

(57) ABSTRACT

A joint connector has a female housing, a male housing, a flexible print circuit (FPC), and a seal member. The female housing has lock holes. The male housing accommodates terminal fittings therein, and has lock projections. Each terminal fitting is accommodated in he male housing in a state in which a resilient piece projects from an outer surface of the male housing. The lock projection is capable of engaging the lock hole. The FPC is accommodated in the female housing. The FPC has conductive foil portions which come into contact with the resilient pieces to electrically connect together the terminal fittings. The seal member keeps the gap between the housings liquid-tight.

9 Claims, 8 Drawing Sheets

JOINT CONNECTOR

CROSS REFERENCE TO RELATED APPLICATION

The present application is based on Japanese Patent Application No. 2001-122644, the entire contents of which are incorporated herein by reference.

BACKGROUND OF THE INVENTION

1. Field of the Invention

The present invention relates to a connector used for connection of electric wires or the like, and more particularly to a joint connector for electrically connecting together terminal fittings, which are accommodated therein, according to a predetermined pattern.

2. Related Art

In a wire harness used in an automobile as a moving body, there are cases where a joint connector 101 (shown in FIG. 9) is used for electrically connecting terminal fittings 102, which are accommodated therein, according to a predetermined pattern. The joint connector 101 shown in FIG. 9 by way of illustration is comprised of the terminal fittings 102, a male connector housing (hereafter referred to as the male housing) 103, a female connector housing (hereafter referred to as the female housing) 104, joint pins 105, and the like.

The terminal fittings 102 are respectively connected to electric wires 106. The male housing 103 has a cubic terminal accommodating portion 107 and an outer-periphery covering portion 108. The terminal accommodating portion 107 has a plurality of terminal accommodating chambers 109 which are capable of accommodating the terminal fittings 102. The outer-periphery covering portion 108 is formed in the shape of a rectangular tube, and has its inner edges continuing to outer edges of the terminal accommodating portion 107. For this reason, the outer-periphery covering portion 108 covers the outer peripheries of the terminal accommodating portion 107. The male housing 103 accommodates the terminal fittings 102 with the wires 106 in the terminal accommodating chambers 109.

The female housing 104 is formed in such a tubular shape that the terminal accommodating portion 107 of the male housing 103 is able to enter its inner side. The female housing 104 has a partition wall 110 in its central portion along the direction of entry of the male housing 103. The partition wall 110 closes the inner side of the female housing 104.

When the male housing 103 has entered the interior of the female housing 104, the joint pins 105 are passed through the partition wall 110 and are respectively brought into contact with the terminal fittings 102. As the joint pins 105 are passed through the partition wall 110 and are respectively brought into contact with the terminal fittings 102, the joint pins 105 electrically connect together the terminal fittings 102.

The two housings 103 and 104 are engaged with each other in a state in which the terminal accommodating portion 107 of the male housing 103 has entered the interior of the female housing 104 and the female housing 104 has entered the inner side of the outer-periphery covering portion 108 of the male housing 103. The joint pins 105 are passed through the partition wall 110 and are brought into contact with the terminal fittings 102, thereby electrically connecting together the terminal fittings 102. The conventional joint connector 101 constructed as described above is thus assembled.

In addition, the above-described conventional joint connector 101 is so arranged that a waterproof cover 111 is attached to the female housing 104 so as to prevent water or the like from becoming attached to portions of contact between the joint pins 105 and the terminal fittings 102. Further, packing 112 is provided between the female housing 104 and the outer-periphery covering portion 108 of the male housing 103. The packing 112 may be attached in advance to one of the female housing 104 and the male housing 103. In addition, after the joint pins 105 are fitted, the waterproof cover 111 is attached to the female housing 104.

With the above-described conventional joint connector 101, since the joint pins 105 are passed through the partition wall 110 of the female housing 104, it has been necessary to attach the waterproof cover 111 to the female housing 104. For this reason, the above-described conventional joint connector 101 tends to become large in size.

SUMMARY OF THE INVENTION

Accordingly, the object of the invention is to provide a joint connector which can be prevented from becoming large in size.

(1) To overcome the above-described problem and attain the object, there is provided a joint connector for accommodating a plurality of terminal fittings and for electrically connecting together the terminal fittings according to a predetermined pattern, characterized by comprising: the terminal fittings; a male housing for accommodating the terminal fittings; a female housing into which the male housing enters and with which the male housing is engaged; and a conductive sheet having electrically conductive toil portions and adapted to be accommodated in the female housing, wherein portions of the terminal fittings respectively project from outer surfaces of the male housing, and when the male housing enters an interior of the female housing, the conductive foil portions are respectively brought into contact with the portions of the terminal fittings to electrically connect together the terminal fittings according to a predetermined pattern.

(2) The joint connector according to (1) is characterized by further comprising: a positional-offset preventing device for preventing the positional offset of the conductive sheet.

(3) The joint connector according to claim 1 or 2 is characterized in that the conductive sheet has an insulating sheet which has insulating properties and on which the conductive foil portions are laminated, and the conductive sheet has flexibility.

(4) The joint connector according to any one of (1) to (3) is characterized by further comprising: a seal member provided all around an end portion the male housing close to an opening of the female housing when the male housing has entered the interior of the female housing, and which keeps liquid-tight a gap between inner peripheral surfaces of the female housing and the outer surfaces of the male housing.

(5) The joint connector according to (4) is characterized in that the seal member is formed in an annular shape and is elastically deformable such that inside and outside diameters thereof expand or contract.

In accordance with the joint connector of the invention according to (1), the conductive foil portions of the conductive sheet accommodated in the female housing connect together the terminal fittings of the male housing. For this reason, there arises no need for electrically conductive pins or the like to be passed through the female housing so as to electrically connect together the terminal fittings.

Accordingly, there arises no need to attach a waterproofing cover or the like to the female housing so as to waterproof portions of contact between the conductive foil portions and the terminal fittings.

In accordance with the joint connector of the invention according to (2), the positional offset of the conductive sheet is prevented. For this reason, the conductive sheet is able to electrically connect together desired ones of the terminal fittings reliably.

In accordance with the joint connector of the invention according to (3), the conductive sheet has the insulating sheet and the conductive foil portions which are laminated thereon, and is flexible. For this reason, the conductive sheet can be made thin. Accordingly, the mechanical size of the conductive sheet can be reduced, and the mechanical size of the female housing in which the conductive sheet is accommodated can be also reduced.

In accordance with the joint connector of the invention according to (4), the seal member is provided all around the male housing. For this reason, it is possible to prevent a liquid such as water from entering the portions of contact between the conductive foil portions and the terminal fittings through the gap between the male housing and the female housing.

In accordance with the joint connector of the invention according to (5), the seal member is formed in an annular shape whose inside and outside diameters are capable of expanding or contracting. For this reason, it is possible to more reliably prevent a liquid such as water from entering the portions of contact between the conductive foil portions and the terminal fittings through the gap between the male housing and the female housing.

In accordance with the joint connector of the invention according to (2), the joint connector according to claim 1, wherein at least one positioning projection projects from an inner side of the female housing and at least one positioning hole is formed in the conductive sheet, and the positioning projection is retained in the positioning hole to thereby constitute the positional-offset preventing device.

DETAILED DESCRIPTION OF THE PREFERRED EMBODIMENT

Figure 3:
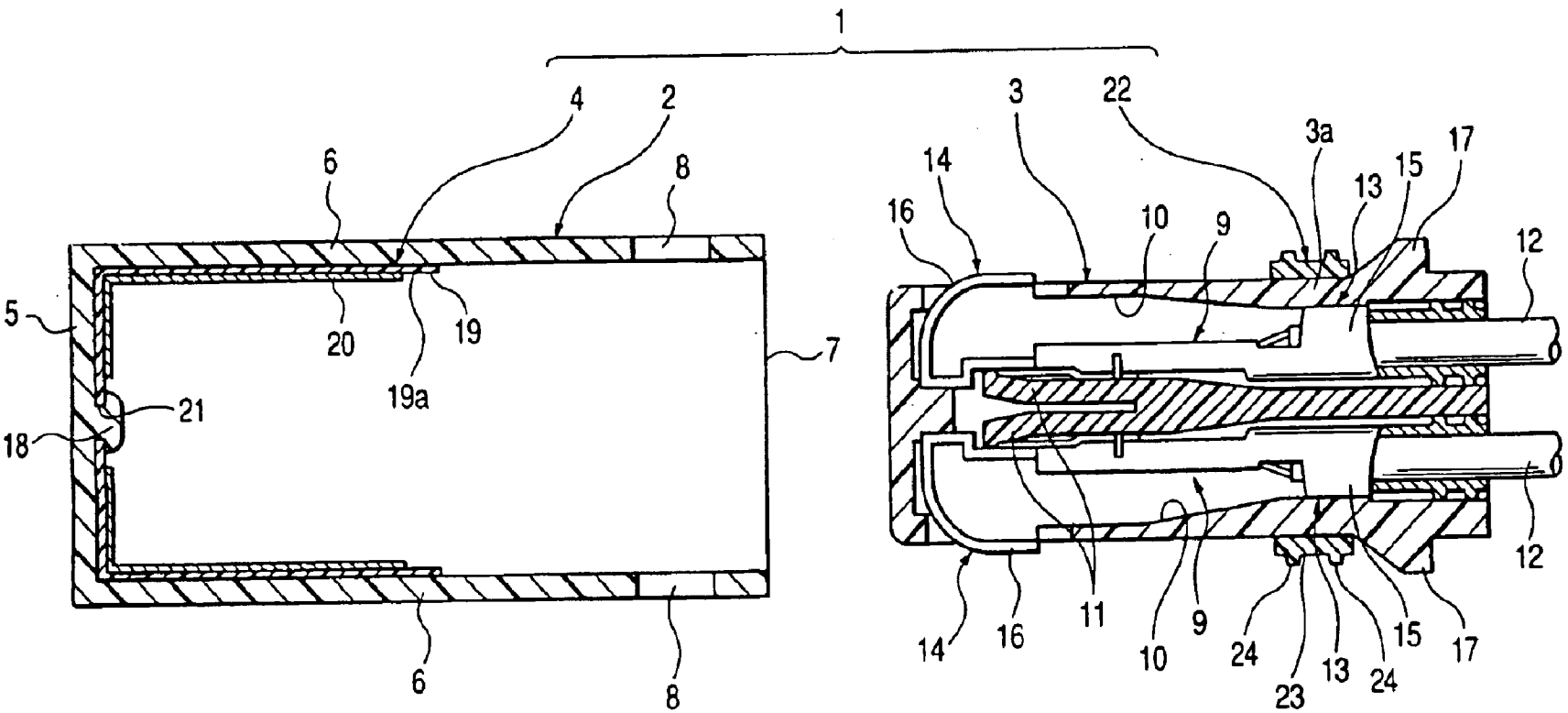
FIG. 3 is a cross-sectional view taken along line III—III in FIG. 1.
Figure 4:
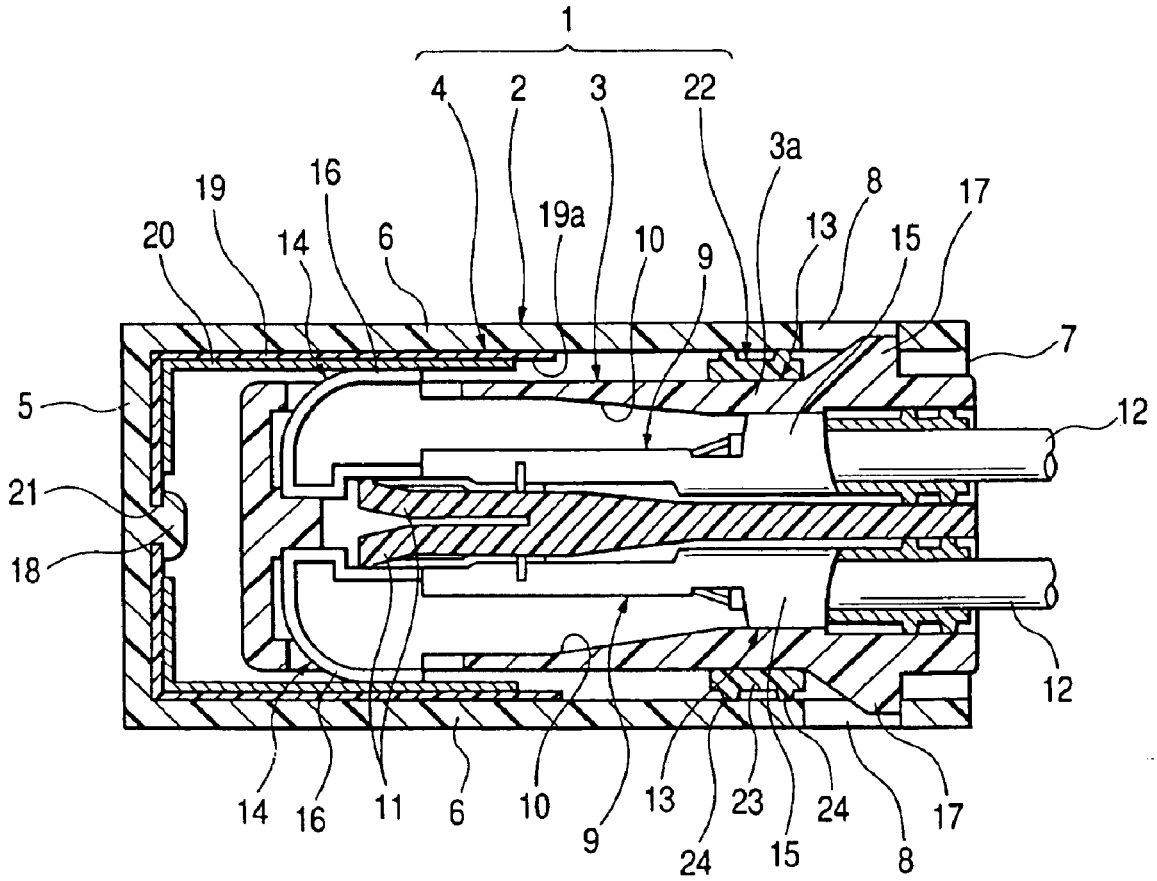
FIG. 4 is a cross-sectional view taken along line IV—IV in FIG. 2.

Referring to FIGS. 1 to 8, a description will be given of a joint connector in accordance with an embodiment of the invention. As shown in FIGS. 3 and 4, a joint connector 1 has a female connector housing (hereafter referred to as the female housing) 2, a male connector housing (hereafter referred to as the male housing) 3, and a flexible printed circuit (FPC) 4.

The female housing 2 is made of a synthetic resin. As shown in FIGS. 1 to 4, the female housing 2 has a bottom wall 5 having a substantially rectangular planar shape and four peripheral walls 6 respectively continuing to four sides of the bottom wall 5, and is thus formed in the shape of a box capable of receiving the male housing 3. The peripheral walls 6 are each formed in the shape of a substantially flat plate, and are provided uprightly on the bottom wall 5. Edges of the peripheral walls 6 located away from the bottom wall 5 form an opening 7 (shown in FIGS. 3 and 4) for receiving the male housing 3. The male housing 3 is inserted into the interior of the female housing 2 through the opening 7.

Two pairs of lock holes 8, which are through holes, are respectively formed in the pair of peripheral walls 6 located on upper and lower sides in the drawings among the four peripheral walls 6. One pair of lock holes 8 provided in one peripheral wall 6 are arranged along a direction which intersects the direction in which the male housing 3 enters the female housing 2. In the illustrated example, one pair of lock holes 8 provided in one peripheral wall 6 are arranged along a direction perpendicular to the direction in which the male housing 3 enters the female housing 2. Lock projections 17, which will be described later, are capable of engaging the respective lock holes 8.

In addition, as shown in FIGS. 3 and 4, a positioning projection 18 is provided on the bottom wall 5 of the female housing 2. The positioning projection 18 projects from a position on the bottom wall 5 located on the inner side of the female housing 2 in the inner direction of the female housing 2. The positioning projection 18 projects from that surface along the direction in which the female housing 3 enters the female housing 2. The positioning projection 18 is provided on a central portion of the bottom wall 5.

The male housing 3 is made of a synthetic resin. As shown in FIGS. 3 and 4, the male housing 3 is formed in the shape of a box and has a plurality of terminal accommodating chambers 10 for accommodating terminal fittings 9. Each terminal accommodating chamber 10 extends straightly along the direction in which the male housing 3 enters the female housing 2, and has a retaining arm 11 for retaining the terminal fitting 9. Each terminal accommodating chamber 10 accommodates the terminal fitting 9 as the retaining arm 11 retains the terminal fitting 9.

The terminal fitting 9 has a wire connecting portion 13 for connecting to an electric wire 12, as well as an electrical contact portion 14 for connecting to another terminal fitting 9. The wire connecting portion 13 has a pair of crimping legs 15 for crimping the wire 12. The wire connecting portion 13 is accommodated in the terminal accommodating chamber 10. The electrical contact portion 14 continues to the wire connecting portion 13. The electrical contact portion 14 has a resilient piece 16 continuing to the crimping legs 15.

Figure 1:
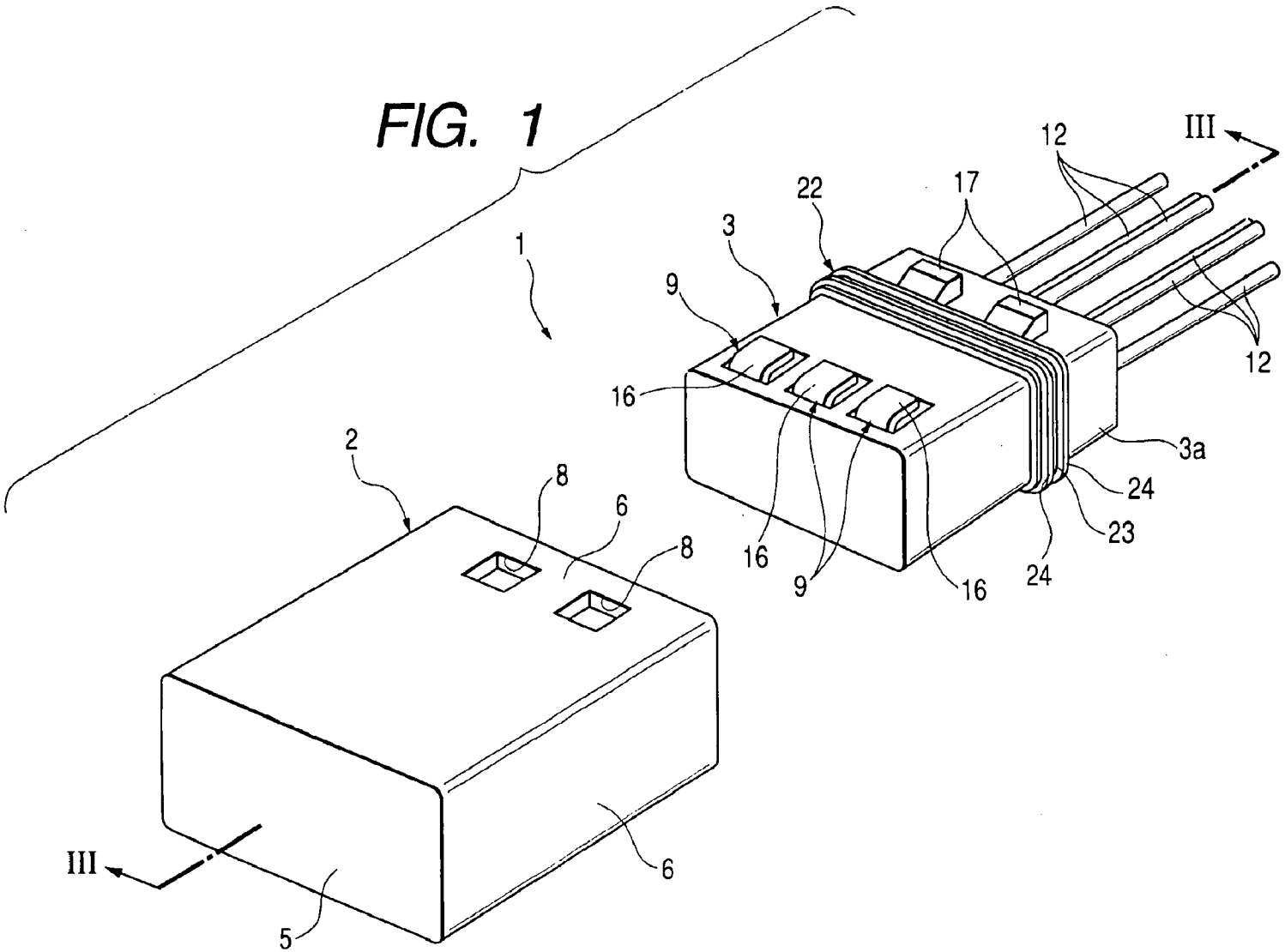
FIG. 1 is an exploded perspective view of a joint connector in accordance with an embodiment off the invention.
Figure 2:
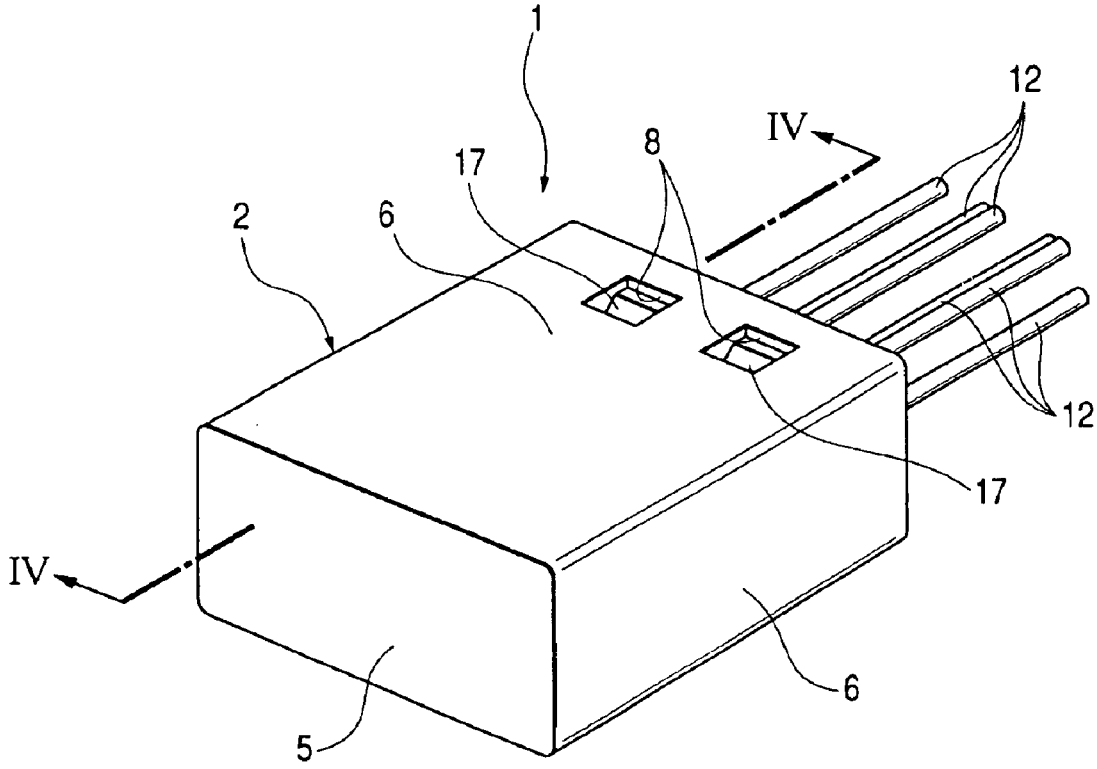
FIG. 2 is a perspective view illustrating the joint connector in accordance with the embodiment.

The resilient piece 16 is formed in the shape of a strip whose one end continues to the wire connecting portion 13. When the wire connecting portion 13 is accommodated in the terminal accommodating chamber 10, the resilient piece 16 projects from an outer surface of the male housing 3 in the outer direction off the male housing 3, as shown in FIGS. 1, 3, and 4. The resilient piece 16 is resiliently deformable such that an amount of its projection from the outer surface of the male housing 3 is changeable. It should be noted that the resilient piece 16 forms that portion of the terminal fitting 9 projecting from the outer surface of the male housing 3 that is described in this specification.

Further, the male housing 3 has the lock projections 17. The lock projections 17 project outward from the outer surface of the male housing 3. The lock projections 17 are disposed at positions where they coincide with the lock holes 8 when the male housing 3 are accommodated in the female housing 2. The lock projections 17 are engaged in the lock holes 8.

Figure 5:
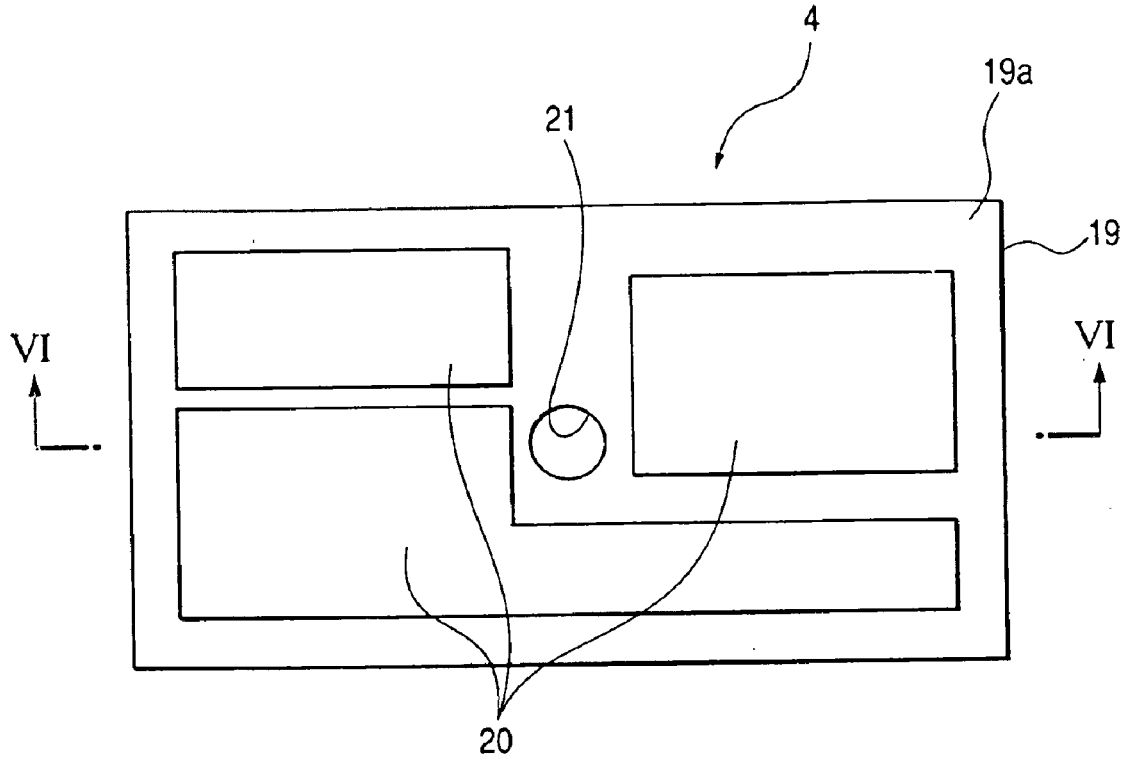
FIG. 5 is a plan view of an FPC of the joint connector in accordance with the embodiment.
Figure 6:
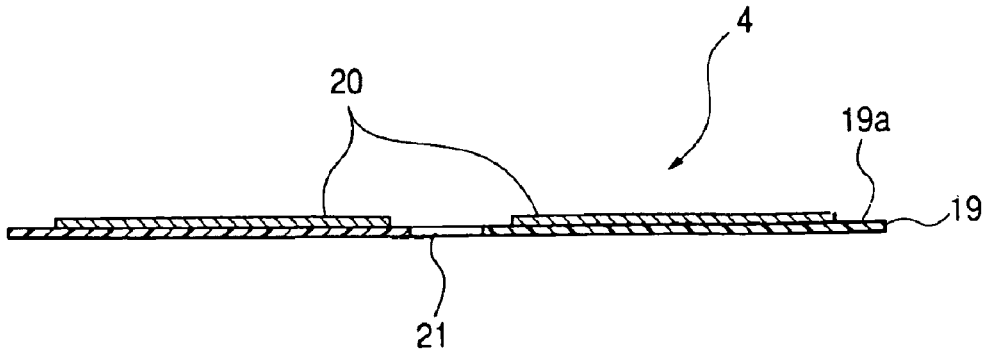
FIG. 6 is a cross-sectional view taken along line VI—VI in FIG. 5.

As shown in FIGS. 5 and 6, the FPC 4 has an insulating sheet 19 having insulating properties, a positioning hole 21, and electrically conductive foil portions 20. The insulating sheet 19 is formed in the shape of a rectangular sheet whose planar shape is larger than the bottom wall 5. The positioning hole 21 is provided in a central portion of the insulating sheet 19 and through the insulating sheet 19.

The positioning projection 18 can be retained in the positioning hole 21. When the positioning projection 18 is retained in the positioning hole 21, the FPC 4 is positioned in the female housing 2. The positioning projection 18 and the positioning hole 21 constitute a positional-offset preventing device described in this specification.

The conductive foil portions 20 are formed of an electrically conductive metal and are formed as thin foils. The conductive foil portions 20 are laminated on a surface 19*a* of the insulating sheet 19. The conductive foil portions 20 are provided at positions where they are brought into contact with the resilient pieces 16 of the terminal fittings 9 when the FPC 4 is positioned in the female housing 2.

The conductive foil portions 20 are formed so as to be able to come into contact with the resilient pieces 16 of the plurality of terminal fittings 9 and to be electrically connected to these terminal fittings 9 in accordance with a predetermined pattern. Namely, the conductive foil portions 20 electrically connect some of the terminal fittings 9 among the plurality of terminal fittings 9 and keep some other terminal fittings 9 in an insulated state.

The FPC 4 having the above-described arrangement has the insulating sheet 19 and the conductive foil portions 20, and is flexible. For this reason, the FPC can be freely bent.

In addition, the above-described joint connector 1 has a seal member 22. The seal member 22 has an annular seal body 23 and a pair of annular lips 24. The seal body 23 of the seal member 22 is elastically deformable such that its inside and outside diameters are capable of expanding or contracting. The seal body 23 of the seal member 22 allows the male housing 3 to be inserted therethrough. For this reason, the seal member 22 is provided all around the male housing 3. When the male housing 3 is inserted into the interior of the female housing 2, the seal member 22 is provided all around an end portion 3*a* of the male housing 3 close to the aforementioned opening 7. The lips 24 are provided on both sides of the seal body 23 in such a manner as to project outward from the outer peripheral surface of the seal body 23. When the male housing 3 enters into the interior off the female housing 2, the lips 24 of the seal member 22 come into contact with the inner peripheral surfaces of the female housing 2, as shown in FIG. 4.

When the male housing 3 enters the interior of the female housing 2, the seal member 22 keeps liquid-tight the gap between the inner peripheral surfaces of the female housing 2 and the outer surfaces of the male housing 3. Then, the seal member 22 prevents a liquid such as water from entering portions of contact between the resilient pieces 16 of the terminal fittings 9 and the conductive foil portions 20.

When the joint connector 1 is assembled, the terminal fittings 9 are first retained by the retaining arms 11 of the male housing 3 and are accommodated in the terminal accommodating chambers 10. The seal member 22 is fitted over the outer surfaces of the male housing 3. At this time, the resilient pieces 16 of the terminal fittings 9 project from the outer surfaces of the male housing 3.

Figure 7:
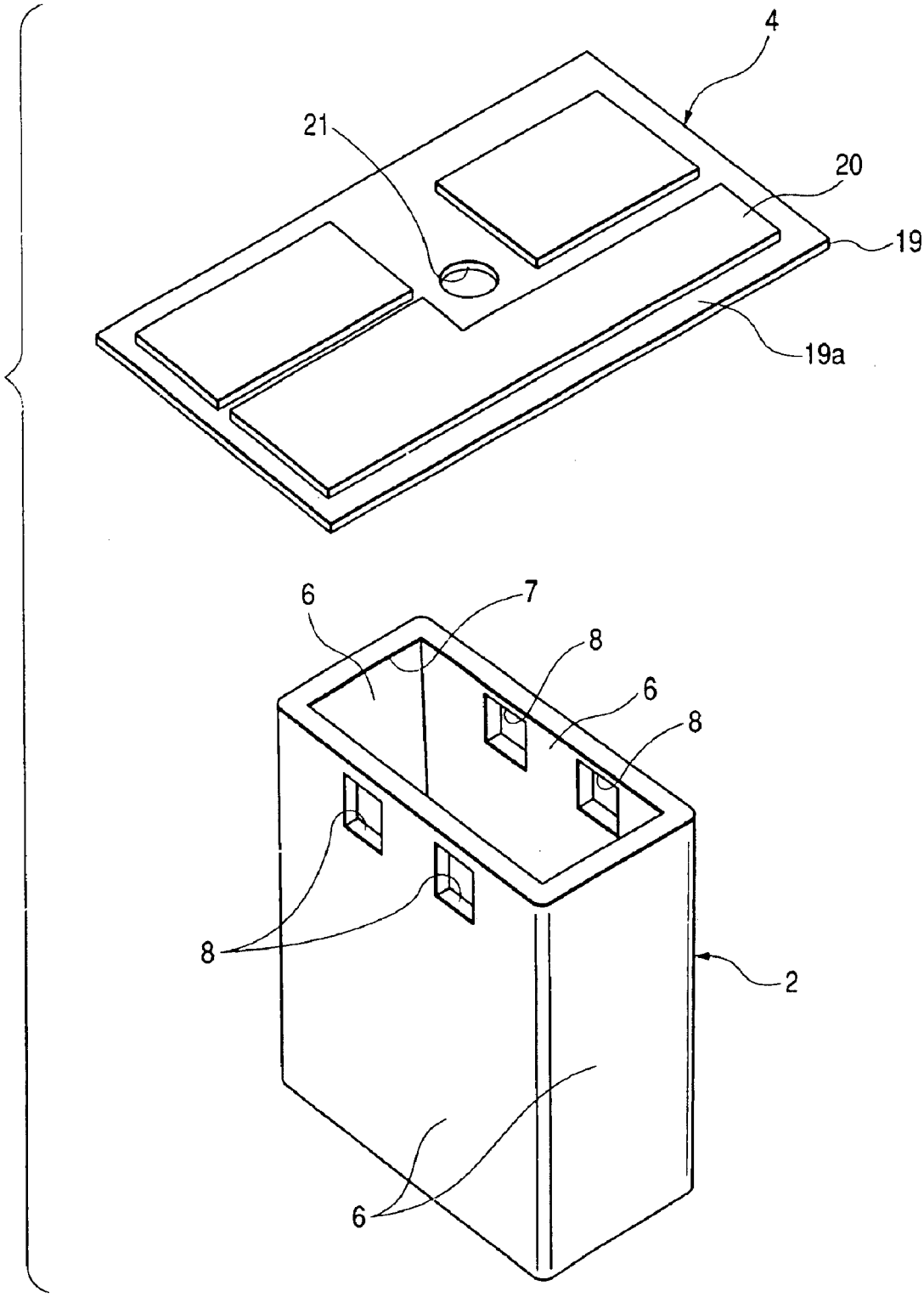
FIG. 7 is a perspective view illustrating a state in which an opening of a female housing and an FPC are made to face each other in the joint connector in accordance with the invention.
Figure 8:
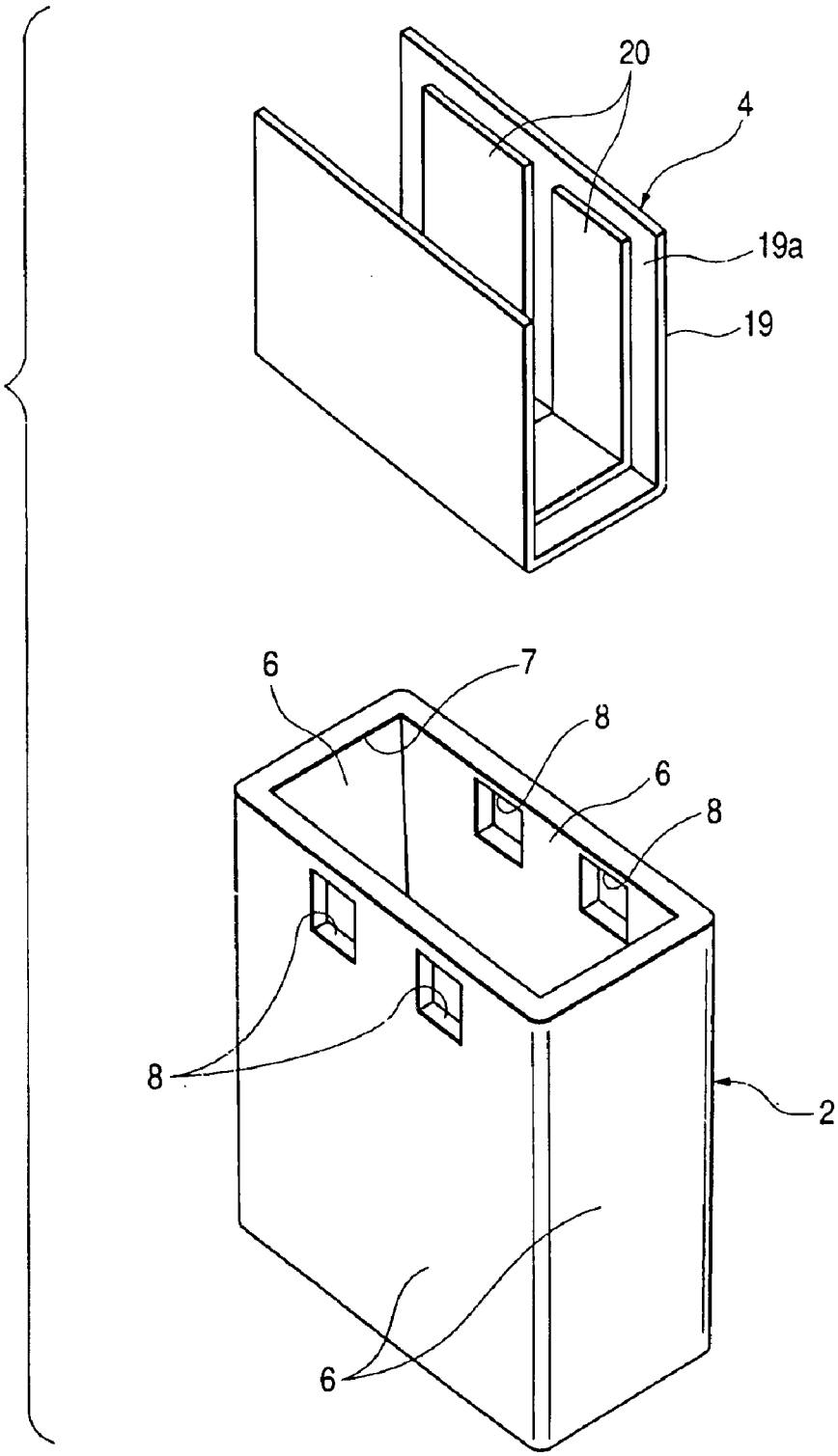
FIG. 8 is a perspective view illustrating a state in which both end portions of the FPC facing the opening of the female housing are bent in the joint connector in accordance with the invention.
Figure 9:
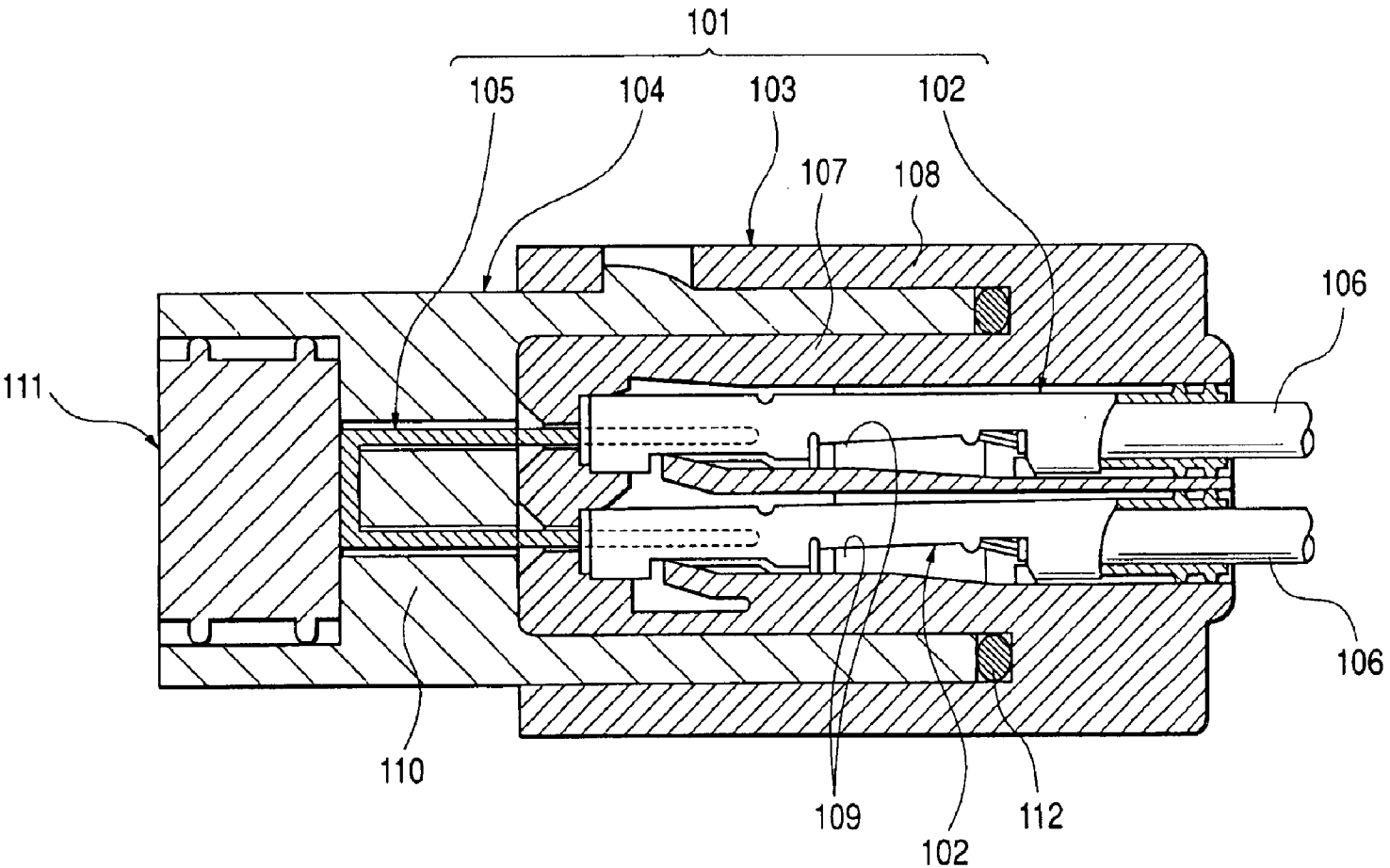
FIG. 9 is a cross-sectional view of a conventional joint connector.

Then, the FPC 4 is made to face the opening 7, as shown in FIG. 7. At this time, the positioning projection 18 and the positioning hole, 21 are made to face each other. Then, as shown in FIG. 8. longitudinal opposite end portions of the FPC 4 are bent, and the FPC 4 is inserted into the female housing 2 such that the conductive foil portions 20 are located more on the inner side of the female housing 2 than the insulating sheet 19. The positioning projection 18 is retained in the positioning hole 21, and the FPC 4 is fixed to the female housing 2.

As shown in FIGS. 1 and 3, the opening 7 of the female housing 2 and the male housing 3 are made to face each other, and the male housing 3 is inserted into the female housing 2. The lock projections 17 are engaged in the lock holes 8 to cause the female housing 2 and the male housing 3 to engage each other, thereby assembling the joint connector 1.

According to this embodiment, the conductive foil portions 20 of the FPC 4 connect together the terminal fittings 9 of the male housing 3. In addition, the FPC 4 is accommodated in the female housing 2. For this reason, there arises no need for electrically conductive pins or the like to be passed through the female housing 2 so as to electrically connect together the terminal fittings 9. Accordingly, there arises no need to attach a waterproofing cover or the like to the female housing 2 so as to waterproof portions of contact between the conductive foil portions 20 and the terminal fittings 9. Thus it is possible to prevent the joint connector 1 from becoming large in size.

The positioning projection 18 is engaged in the positioning hole 21, and the FPC 4 is positioned with respect to the female housing 2. For this reason, the FPC 4 is able to electrically connect together desired ones of the terminal fittings 9 reliably. Accordingly, apart from the fact that the joint connector 1 can be prevented from becoming large in size, desired ones of the terminal fittings 9 can be electrically connected together reliably.

The FPC 4 has the insulating sheet 19 and the conductive foil portions 20 which are laminated thereon, and is flexible. For this reason, the FPC 4 can be made thin. Accordingly, the mechanical size of the FPC 4 can be reduced, and the mechanical size of the female housing 2 in which the FPC 4 is accommodated can be also reduced. Therefore, it is possible to further prevent the joint connector 1 from becoming large in size.

The seal member 22 is provided all around the male housing 3. For this reason, it is possible to prevent a liquid such as water from entering the portions of contact between the conductive foil portions 20 and the terminal fittings 9 through the gap between the male housing 3 and the female housing 2. Accordingly, apart from the fact that the joint connector 1 can be prevented from becoming large in size, it is possible to more reliably prevent a liquid such as water from becoming attached to the portions of contact between the conductive foil portions 20 and the terminal fittings 9.

The seal member 22 is formed in an annular shape whose inside and outside diameters are capable of expanding or contracting. For this reason, the seal member 22 makes it possible to more reliably prevent a liquid such as water from entering the portions of contact between the conductive foil portions 20 and the terminal fittings 9 through the gap between the male housing 3 and the female housing 2. Accordingly, it is possible to more reliably prevent the liquid such as water from becoming attached to the portions of contact between the conductive foil portions 20 and the terminal fittings 9.

As described above, in the invention, the conductive foil portions of the conductive sheet electrically connect together the terminal fittings. For this reason, there arises no need for electrically conductive pins or the like to be passed through the female housing so as to electrically connect together the terminal fittings. In addition, the conductive sheet is accommodated in the female housing. Accordingly, there arises no need to attach a waterproofing cover or the like to the female housing so as to waterproof portions of contact between the conductive foil portions and the terminal fittings. Hence, it is possible to prevent the joint connector from becoming large in size.

In the invention, the positional offset of the conductive sheet can be prevented. For this reason, the conductive sheet is able to electrically connect together desired ones of the terminal fittings reliably. Accordingly, apart from the fact that the joint connector is prevented from becoming large in size, it is possible to electrically connect together desires ones of the terminal fittings reliably.

In the invention, the conductive sheet has the insulating sheet and the conductive foil portions which are laminated thereon, and is flexible. For this reason, the conductive sheet can be made thin. Accordingly, the mechanical size of the conductive sheet can be reduced, and the mechanical size of the female housing in which the conductive sheet is accommodated can be also reduced. Accordingly, it is possible to further prevent the joint connector from becoming large in size.

In the invention, the seal member is provided all around the male housing. For this reason, it is possible to prevent a liquid such as water from entering the portions of contact between the conductive foil portions and the terminal fittings through the gap between the male housing and the female housing. Accordingly, apart from the fact that the joint connector can be prevented from becoming large in size, it is possible to reliably prevent a liquid such as water from entering the portions of contact between the conductive foil portions and the terminal fittings through the gap between the male housing and the female housing.

In the invention, the seal member is formed in an annular shape whose inside and outside diameters are capable of expanding or contracting. For this reason, it is possible to more reliably prevent a liquid such as water from entering the portions of contact between the conductive foil portions and the terminal fittings through the gap between the male housing and the female housing. Accordingly, apart from the fact that the joint connector can be prevented from becoming large in size, it is possible to more reliably prevent a liquid such as water from entering the portions of contact between the conductive foil portions and the terminal fittings through the gap between the male housing and the female housing.

What is claimed is:

1. A joint connector for accommodating a plurality of terminal fittings and for electrically connecting together said terminal fittings according to a predetermined pattern, said joint connector comprising:

said terminal fittings;

a male housing for accommodating said terminal fittings;

a female housing into which said male housing enters and with which said male housing is engaged; and a conductive sheet having electrically conductive foil portions and which is directly fixed to a bottom wall as well as two opposing side walls of an inner end portion of said female housing, wherein portions of said terminal fittings project from outer surfaces of said male housing, and when said male housing enters an interior of said female housing, said conductive foil portions are respectively brought into contact with said portions of said terminal fittings to electrically connect together said terminal fittings according to a predetermined pattern.

2. The joint connector according to claim 1, further comprising:

a positional-offset preventing device for preventing positional offset of said conductive sheet.

3. The joint connector according to claim 1, wherein said conductive sheet includes an insulating sheet which has insulating properties and on which said conductive foil portions are laminated, and said conductive sheet has flexibility.

4. The joint connector according to claim 1, further comprising:

a seal member provided all around an end portion said male housing close to an opening of said female housing when said male housing is inserted into the interior of said female housing, and wherein a gap between inner peripheral surfaces of said female housing and the outer surfaces of said male housing is liquid-tightly sealed by said seal member.

5. The joint connector according to claim 4, wherein said seal member is formed in an annular shape and is elastically deformable such that inside and outside diameters thereof expand or contract.

6. The joint connector according to claim 2, wherein at least one positioning projection projects from an inner side of said female housing and at least one positioning hole is formed in said conductive sheet, and said positioning projection is retained in said positioning hole to thereby constitute said positional-offset preventing device.

7. The joint connector according to claim 6, wherein said at least one positioning projection is provided on a central portion of a bottom wall of said female housing, and wherein said at least one positioning hole is formed in a central portion of said conductive sheet.

8. The joint connector according to claim 1, wherein said inner end portion of said female housing is disposed opposite to an end where said male housing enters said female housing.

9. The joint connector according to claim 1, wherein said terminal fittings of said male housing do not pass through said bottom wall or side walls of said female housing when said male housing is inserted into said female housing.

* * * * *